US007032481B2

(12) United States Patent
Li et al.

(10) Patent No.: US 7,032,481 B2
(45) Date of Patent: Apr. 25, 2006

(54) CONSTANT FORCE SOCKET

(75) Inventors: Ming-Hua Li, Tai Chung (TW); Li-Hsia Lin, Tai Chung (TW); Mei-Chin Chou, Tai Ping (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 10/722,429

(22) Filed: Nov. 28, 2003

(65) Prior Publication Data

US 2005/0115369 A1 Jun. 2, 2005

(51) Int. Cl.
*B25B 23/157* (2006.01)

(52) U.S. Cl. ..... 81/429; 81/475; 81/58.3

(58) Field of Classification Search ..... 81/429, 81/58.3, 467, 473, 475, 60, 124.6, 124.7, 81/124.3, 124.5
See application file for complete search history.

(56) References Cited

U.S. PATENT DOCUMENTS 145,399 A * 12/1873 Colbert ..... 81/58.3
1,328,087 A * 1/1920 Le Chot ..... 81/58.3
1,521,331 A * 12/1924 Sedgley ..... 81/58.3
3,667,250 A * 6/1972 Schnepel ..... 464/36
3,957,096 A * 5/1976 Rodman ..... 81/58.3
4,346,633 A * 8/1982 Rendl ..... 81/475
4,939,961 A * 7/1990 Lee ..... 81/60
4,964,319 A * 10/1990 Chang ..... 81/58.3
5,595,095 A * 1/1997 Hillinger ..... 81/60
5,813,298 A * 9/1998 Beattie ..... 81/475
5,850,767 A * 12/1998 Newman ..... 81/58.3
6,158,308 A * 12/2000 Huang ..... 81/60
6,349,625 B1 * 2/2002 Poganski ..... 81/475

* cited by examiner

*Primary Examiner*—Hadi Shakeri
(74) *Attorney, Agent, or Firm*—Rabin & Berdo, P.C.

(57) ABSTRACT

A constant force socket is constructed to include a socket body, which has an inner hole at one end and a set of teeth radially disposed inside the inner hole, a ratchet wheel, which is mounted inside the inner hole of the socket body and has a tool hole at one side and a set of radially arranged teeth at an opposite side, a screw member threaded into the inner hole of the socket body, and a compression spring supported between the ratchet wheel and the screw member to force the teeth of the ratchet wheel into engagement with the teeth of the socket body.

1 Claim, 5 Drawing Sheets

CONSTANT FORCE SOCKET

BACKGROUND OF THE INVENTION

1. Field of the Invention

The present invention relates generally to a socket for use with a wrench or the like to turn bolts and nuts, and more particularly, to a constant force socket, which enables the user to apply a constant torsional force to the workpiece.

2. Description of the Related Art

Regular torsion tools include two types, namely, the conventional mechanical types and the electronic types. These two different types of torsion tools have different prices and are for different applications. Regular sockets for use with torsion tools do not provide an applied force or torsional force control function. Ease of use is the only function of conventional sockets. When in use, a socket works as an adapter between the torsion tool (wrench or power hand tool) and the workpiece (screw bolt or not). During use, the control and maintenance of applied force are completely decided by the user. However, it is difficult to get the information of the margin of safety of every product from the assembly line. An electronic torsion tool (for example, an electronic wrench) can only measure the amount of force applied at each time. It cannot control the amount of applied force, or keep the applied force within a constant range.

A conventional socket is to be sued with a torsion tool to lock/unlock a bolt or nut. However, the locking force is determined subject to the user's feeling. Excessively high locking force may cause damage to the workpiece. Insufficient locking force cannot lock the workpiece positively.

FIG. 1 shows a conventional socket for use with a torsion tool to turn a bolt or nut. This structure of socket may be made in different sizes to fit different bolts and nuts. However, this structure of socket cannot control the applied torsional force.

SUMMARY OF THE INVENTION

The present invention has been accomplished under the circumstances in view. It is the main object of the present invention to provide a constant force socket, which enables the user to adjust apply a constant torsional force to the workpiece. It is another object of the present invention to provide a constant force socket, which enables the user to adjust the set torsional force.

To achieve these and other objects of the present invention, the constant force socket comprises a socket body, the socket body having an inner hole axially extended to one end thereof and a set of teeth radially disposed around the border inside the inner hole; a ratchet wheel mounted in the inner hole inside the socket body, the ratchet wheel having a tool hole disposed at one side thereof and adapted to receive a torsion tool to be inserted into the inner hole of the socket body, and a set of teeth radially disposed at an opposite side thereof and adapted to engage the teeth of the socket body; a screw member threaded into the inner hole of the socket body; and spring means mounted in the inner hole inside the socket body and stopped between the screw member and the ratchet wheel to force the ratchet wheel into engagement with the teeth of the socket body. By means of rotating the screw member inwards/outwards in the inner hole of the socket body, the spring force of the spring means is adjusted, and therefore the set torsional force is relatively changed.

DETAILED DESCRIPTION OF THE INVENTION

Figure 1:
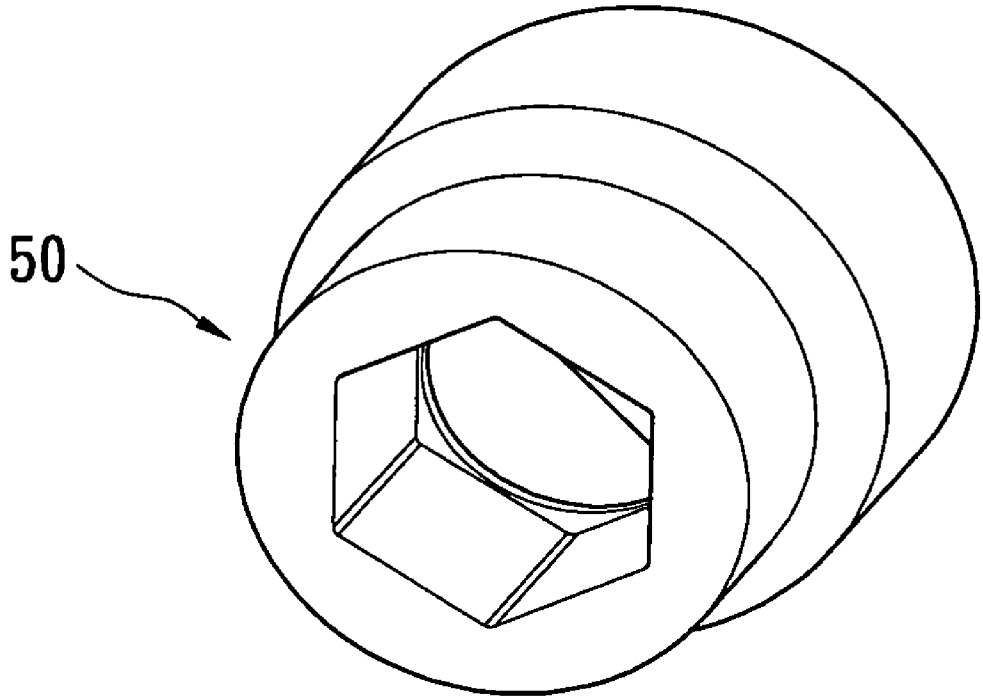
FIG. 1 PRIOR ART
FIG. 1 is an elevational view of a socket according to the prior art.
Figure 4:
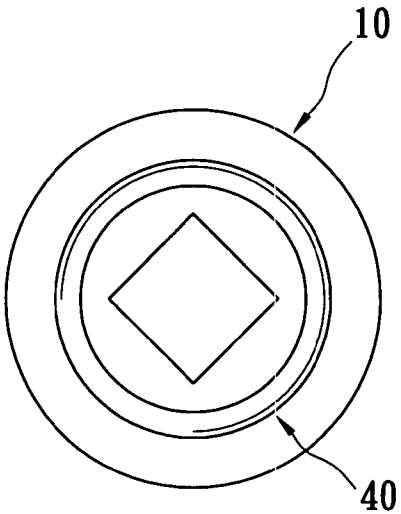
FIG. 4 is a right side view of the constant force socket according to the present invention.
Figure 2:
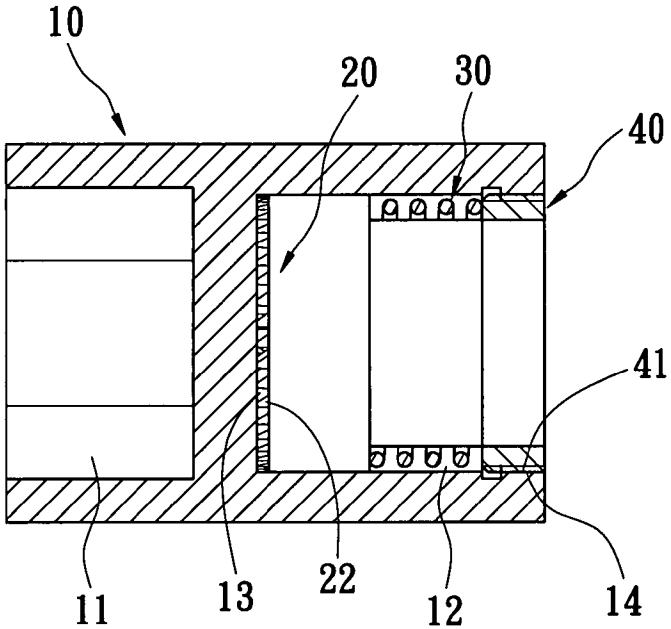
FIG. 2 is a sectional view of a constant force socket according to the present invention.
Figure 3:
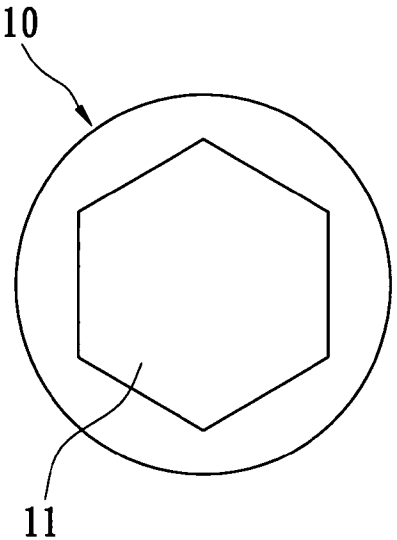
FIG. 3 is a left side view of the constant force socket according to the present invention.

Referring to FIGS. 2~4, a constant force socket in accordance with the present invention is shown comprised of a socket body 10, a stepped ratchet wheel 20, a spring member 30, and a screw member 40.

Figure 5:
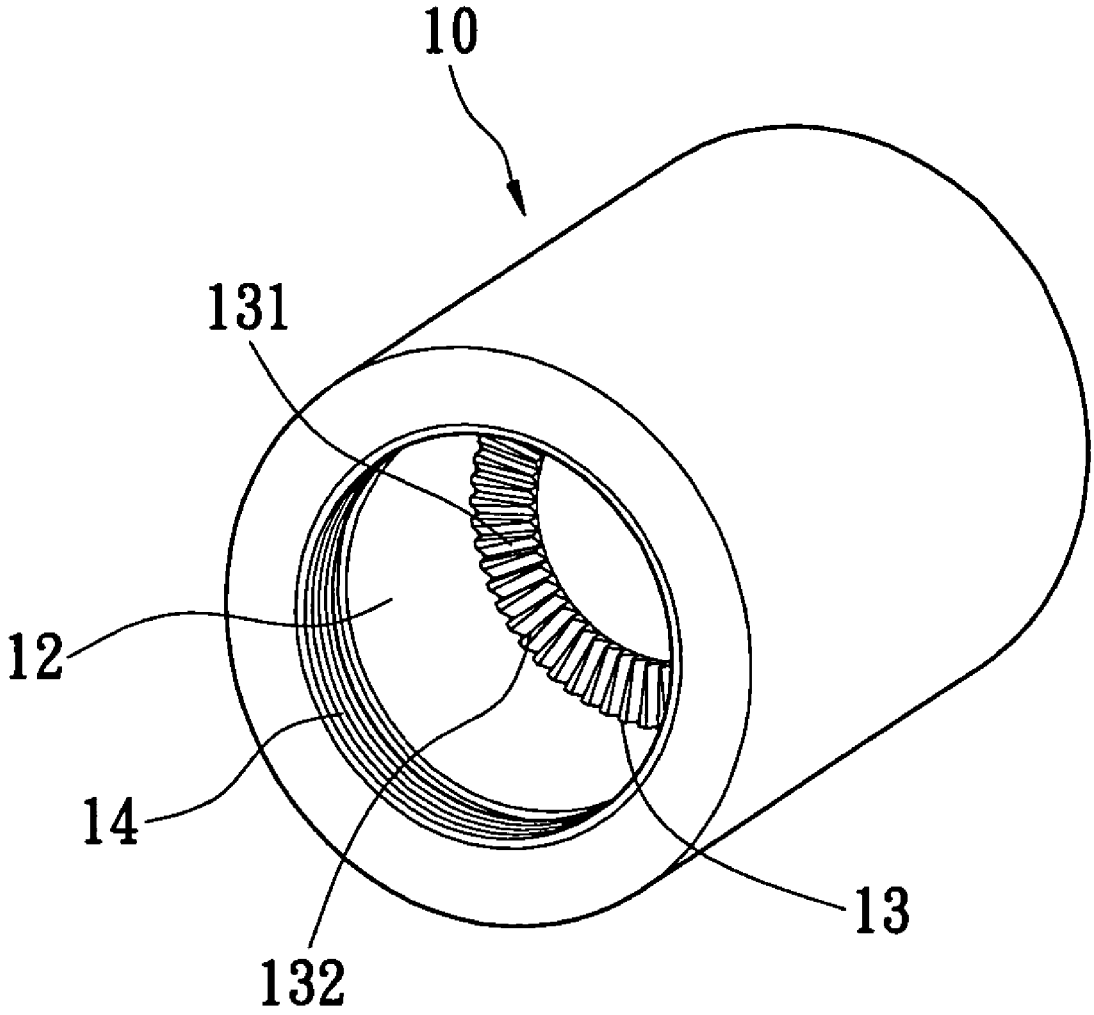
FIG. 5 is an elevational view of the socket body for the constant force socket according to the present invention.

The socket body 10 is a hollow block having a coupling hole 11 axially extended to one end and adapted to receive a locating member (for example a screw nut or screw bolt), an inner hole 12 axially extended to the other end, a set of teeth 13 radially disposed at the inner side inside the inner hole 12 (see FIG. 5), and an inner thread 14 extended around the inside wall within the inner hole 12 near the outer side. The teeth 13 each have a first sidewall 131 and a second sidewall 132 respectively sloping at two sides at different angles for locking/unlocking control. Alternatively, the teeth 13 can be made having the respective first sidewall 131 to be a sloping wall and the respective second sidewall 132 to be a vertical wall.

Figure 6A:
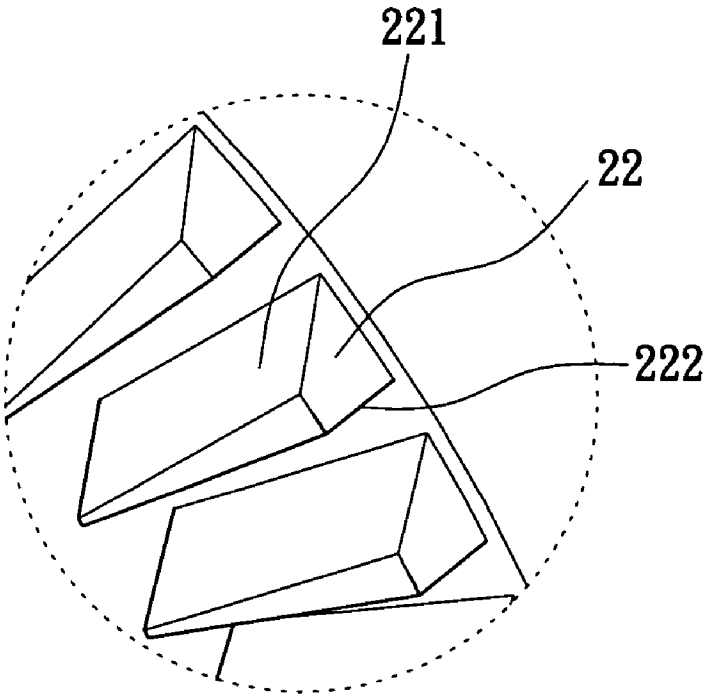
FIG. 6A is an enlarged view of part A of FIG. 6.
Figure 6:
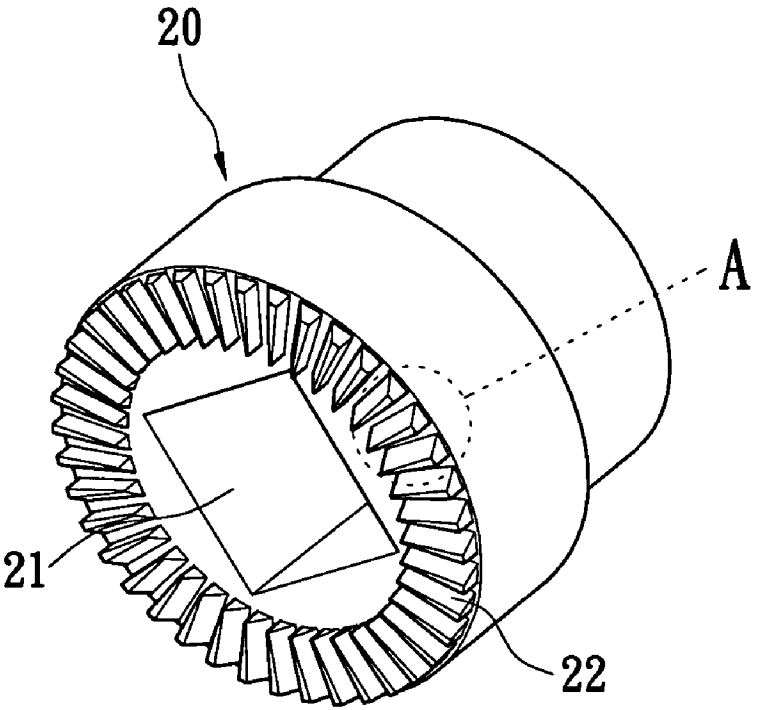
FIG. 6 is a perspective view of the ratchet wheel for the constant force socket according to the present invention.
Figure 7:
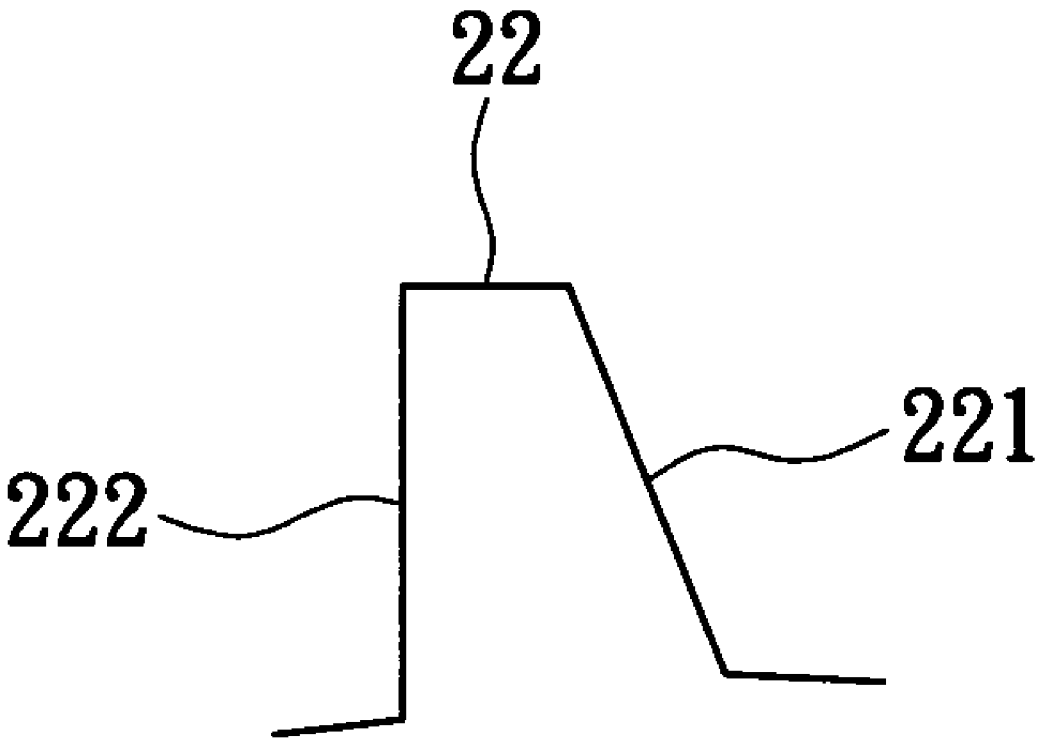
FIG. 7 is a schematic drawing showing the tooth form of the ratchet wheel for the constant force socket according to the present invention.

The stepped ratchet wheel 20 is mounted inside the inner hole 12, having an axially extended tool hole 21 (see FIG. 6) adapted to receive a torsional tool, and a series of teeth 22 radially arranged along the periphery at one end (see FIGS. 6 and 6A). The teeth 22 each have a first sidewall 221 and a second sidewall 222 respectively sloping at two sides at different angles for locking/unlocking control. Alternatively, the teeth 22 can be made having the respective first sidewall 221 to be a sloping wall for locking control and the respective second sidewall 222 to be a vertical wall for unlocking control (see FIG. 7). After engagement between the teeth 22 of the stepped ratchet wheel 20 and the teeth 13 of the socket body 10, the constant force socket can be driven to lock/unlock the workpiece, for example, a screw bolt or the like. When locked, the teeth 22 of the stepped ratchet wheel 20 and the teeth 13 of the socket body 10 trip out automatically.

The spring member 30 is a compression spring received inside the inner hole 12 and sleeved onto the stepped ratchet wheel 20, having one end stopped against the ratchet wheel 20 and the other end. The spring member 30 forces the stepped ratchet wheel 20 into engagement with the teeth 13 of the socket body 10, enabling the teeth 22 of the stepped ratchet wheel 20 and the teeth 13 of the socket body 10 to trip out automatically after the workpiece (screw bolt or nut) has been locked. The positioning of the spring member 30 is not limited to the aforesaid arrangement, i.e., the spring member 30 can be set in any of a variety of positions that achieve the same effect.

The screw member 40 is a hollow member stopped against the other end of the spring member 30, having an outer thread 41 extended around the periphery and threaded into the inner thread 14 of the socket body 10. By means of rotating the screw member 40 inwards or outwards in the inner hole 12, the spring force of the spring member 30 is relatively adjusted. Therefore, the screw member 40 has two functions, one to hold down the parts of the constant force socket, and the other to adjust the torsion. After adjustment of the screw member 40, the screw member 40 may be welded to the socket body 10, or locked to the socket body 10 by lock means (not shown). Alternatively, the screw member 40 can movably be threaded into the inner thread 14 inside the inner hole 12 of the socket body 10 without locking for convenient adjustment.

When assembled, the teeth 22 of the stepped ratchet wheel 20 are meshed with the teeth 13 of the socket body 10 for transmission of rotary driving force, and the spring member 30 is stopped between the screw member 40 and the ratchet wheel 20 to keep the ratchet wheel 20 in engagement with the teeth 13. When in use, the coupling hole 11 of the socket body 1 can be attached to any of a variety of screw bolts and nuts, and the tool hole 21 of the ratchet wheel 20 can receive a torsion tool for turning the constant force socket and the workpiece to which the coupling hole 11 of the socket body 1 is attached. The spring member 30 holds down the ratchet wheel 30 in engagement with the teeth 13 of the socket body 10, and gives a room for enabling the ratchet wheel 20 to trip out when the applied force surpassed the set torsion during working.

If the applied force surpassed the set torsional force when locking the workpiece (screw bolt or nut) with a torsion tool, the teeth 13 and 22 will automatically trip out along the first sidewalls 131 and 221, and then the teeth 22 will be forced into engagement with the teeth 13 again by the spring member 30 after the ratchet wheel 20 has been biased through an angle. Further, the engagement between second sidewalls 132 and 222 prevents trip-out of the ratchet wheel 20 from the socket body 10 when rotated in the reversed direction to loosen the workpiece (screw bolt or not).

As indicated above, if the applied force surpassed the set torsional force of the constant force socket when locking the workpiece (screw bolt or nut), the constant force trips out automatically to run idle, preventing damage to the constant force socket. When loosening the workpiece (screw bolt or not), the constant force socket is prohibited from tripping out, and can be driven to loosen the workpiece (screw bolt or nut) directly and positively.

It is not requisite to use the constant force socket with an electronic torsion tool (for example, an electronic wrench). Without an electronic torsion tool, the invention achieves torsion control. The constant force socket of the present invention is practical for use in any of a variety of industries including machinery industry, automobile industries, electronic equipment industry, food equipment industry, and etc., to lock or unlock screw bolts and nuts.

As indicated above, after installation of the screw member 40, the spring member 30 and the ratchet wheel 20 in the socket body 10, the acceptable torsional force of the socket is set. When locking the workpiece (screw bolt or nut), the maximum torsional force is transmitted through the constant force socket to the workpiece. When unlocking the workpiece, the ratchet wheel does not trip out, and the torsional force is positively transmitted to the workpiece, causing the workpiece to be accurately unlocked (loosened).

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A constant force socket, comprising:

a socket body having two, opposing, axially aligned holes formed therein, a first one of the holes being a coupling hole adapted to receive a workpiece therein, and a second one of the holes being an inner hole, the inner hole having an interior threaded region located proximate an open end thereof, a bottom of the inner hole having a ring of teeth thereat, the ring of teeth extending around an entire inside periphery of the inner hole, each tooth in said ring of teeth having an inclined side and a vertical side;

a ratchet wheel disposed inside the inner hole, and having a first end and a second end, and having a first region and a second region, the first region having a diameter that is greater than a diameter of the second region, the first region terminating at the first end and the second region terminating at the second end, said ratchet wheel further comprising a ring of teeth disposed at the first end thereof, each tooth in said ring of teeth of said ratchet wheel having an inclined side and a vertical side, the ring of teeth of said ratchet wheel engaging the ring of teeth of said socket body, said ratchet wheel further having a torsion tool hole with an opening thereof being formed at the second end, the torsion tool hole being adapted to receive a tool;

a coil spring mounted around the second region of said ratchet wheel, and having a first end that abuts against the first region of said ratchet wheel to urge the ring of teeth of said ratchet wheel into meshing engagement with the ring of teeth of said socket body; and a toroid-shaped pressure adjusting element having an exterior threaded region threadably engaging the interior threaded region in said inner hole, said pressure adjusting element pressing against a second end of said coil spring, whereby rotation of said pressure adjusting element within said inner hole adjusts an amount of pressed force on said spring and thus on said ratchet wheel, an inner hole of said pressure adjusting element being in axial alignment with the torsion tool hole, so that the tool, when it is received in the torsion tool hole, passes freely through the inner hole of said pressure adjusting element;

wherein when said constant force socket is utilized to tighten the workpiece, the inclined sides of the teeth of said socket body engage with the inclined sides of the teeth of said ratchet wheel, until a predetermined force therebetween causes said ratchet wheel to overcome the pressed force of said spring and to move in a direction of said pressure adjusting element, thereby causing the teeth of said socket body to disengage with the teeth of said ratchet wheel; and wherein when said constant force socket is utilized to loosen the workpiece, the vertical sides of the teeth of said socket body engage with the vertical sides of the teeth of said ratchet wheel, to prevent the teeth of said socket body from disengaging with the teeth of said ratchet wheel.

* * * * *